United States Patent [19]

Verdi

[11] Patent Number: 4,749,098

[45] Date of Patent: Jun. 7, 1988

[54] FILE CARD CONTAINER

[75] Inventor: Anthony J. Verdi, Whippany, N.J.

[73] Assignee: Ketcham & McDougall, Inc., Roseland, N.J.

[21] Appl. No.: 87,782

[22] Filed: Aug. 21, 1987

[51] Int. Cl.[4] ..... B65D 57/00

[52] U.S. Cl. ..... 220/22.5; 220/334; 206/425

[58] Field of Search ..... 220/22.5, 22.6, 334; 206/425

[56] References Cited

U.S. PATENT DOCUMENTS

| | | | |
|---|---|---|---|
| 2,822,810 | 2/1958 | Hailes | 220/22.5 |
| 3,589,523 | 1/1971 | Belden | 220/22.5 |
| 3,784,046 | 1/1974 | Cata | 220/334 |
| 3,861,556 | 1/1975 | Barecki et al. | 220/334 |
| 3,881,597 | 5/1975 | Dahl, Jr. | 220/22.5 |
| 3,893,585 | 7/1975 | Morrison et al. | 220/22.6 |

*Primary Examiner*—Joseph Man-Fu Moy

*Attorney, Agent, or Firm*—Collard, Roe & Galgano

[57] ABSTRACT

A file card container is disclosed which includes a hollow base having an open top and front and rear portions. A cover is provided for enclosing the open top of the base. A first pivot interconnection pivotally connects the cover to the rear portion of the base. A carrier plate having front and rear ends is slidably mounted within the hollow base. A second pivot interconnection pivotally connects the cover to the rear of the carrier plate. The axis of rotation of the first and second pivot interconnections are parallel with the first pivot connection being disposed rearwardly of the second pivot connection when the cover is in the closed position. A spring is coupled to the base and the carrier plate is capable of urging the carrier rearwardly and the cover to an open position. A device is included to lock the cover in the closed position against the action of the spring.

12 Claims, 5 Drawing Sheets

FILE CARD CONTAINER

BACKGROUND OF THE INVENTION

1. Field of the Invention

The invention pertains to a new and improved file card container adapted to conveniently store and display index cards. More specifically, the invention relates to a card file container wherein a stack of cards, such as index cards, are stored in a manner that, when the lid is opened, the cards are effectively presented for use and are effectively positioned for storage purposes when the lid of the container is closed.

2. Description of the Prior Art

Index or file card holders and containers are well known. U.S. Pat. No. 1,825,332 which issued on Sept. 29, 1931 to D. F. Benbow and U.S. Pat. No. 2,508,984 which issued on May 23, 1950 to F. E. Zebrowski disclose card holders which accomodate cards in such a manner that when the lid is open, the index cards are presented for use.

U.S. Pat. No. 4,325,595 which issued on Apr. 20, 1982 to Jack Soloman discloses a card file box which has a front pivotal wall which falls forward when the lid is open to present the contents of the file for use. U.S. Pat. No. 4,164,309 which issued on Aug. 14, 1979 to David K. Staats discloses a document storage case having inclined ramps and document supports to cause the cards or documents to tilt rearwardly to present themselves to the user. U.S. Pat. No. 4,498,583 which issued on Feb. 12, 1985 to Long et al discloses a diskette storage container in which cam surfaces act on the diskette support member as the lid is moved to the open position. This allows the diskette support member to drop forward and improve accessibility to the diskettes. A locking arrangement is included to prevent access to the contents stored in the container.

U.S. Pat. No. 30,624 which was reissued on May 26, 1981 to Soulakis et al discloses a container card structure which includes an index card carrier that is moved rearwardly and upwardly as the lid is opened to better display the index cards. A spring is provided to prevent the lid from rapidly closing.

U.S. Design Patents Nos. 243,526, 255,805, 258,295 and 259,496 all show various card files which have lids hingedly connected to the card carrying base.

None of the above referenced prior art discloses a card container which is self actuating in that unlatching of the lid automatically opens the container and presents the cards in position for use. Nor does the prior art disclose a file card container which automatically places the cards in a storage position upon closing the lid.

SUMMARY OF THE INVENTION

It is an object of this invention to provide an index card file container which may be easily opened and which upon opening automatically presents the index card files in an advantageous position for use.

It is yet a further object of this invention to provide an index card holder which upon closing the lid, moves the index cards to a position for storage which minimizes the size of the closed container.

It is a further object of this invention to provide an index card file container which is light, compact, simple to operate and economical to manufacture.

Accordingly, the present invention provides a card file container having a generally open base. A lid is pivotally connected to the rear portion of the base and the lid is capable of pivoting from an open position to a closed position covering the open top of the base. A card carrier plate is slidably mounted within the base and is pivotally connected to the lid. The pivot connection between the base and the lid is disposed rearwardly of the pivot connection between the lid and the carrier means. Thus, when the lid moves from the closed position to the open position, the card carrier plate slides rearwardly and upwardly presenting the cards for use. A spring is coupled to the base and is capable of urging the carrier means rearwardly and consequently the lid to the open position. The base includes a locking mechanism for locking the lid in the closed position against the action of the spring.

These and other objects and advantages of the present invention will become apparent from the following description of the accompanying drawings, which disclose several embodiments of the invention. It is to be understood that the drawings are to be used for the purpose of illustration only, and not as a definition of the invention.

DESCRIPTION OF THE PREFERRED EMBODIMENTS

Figure 1:
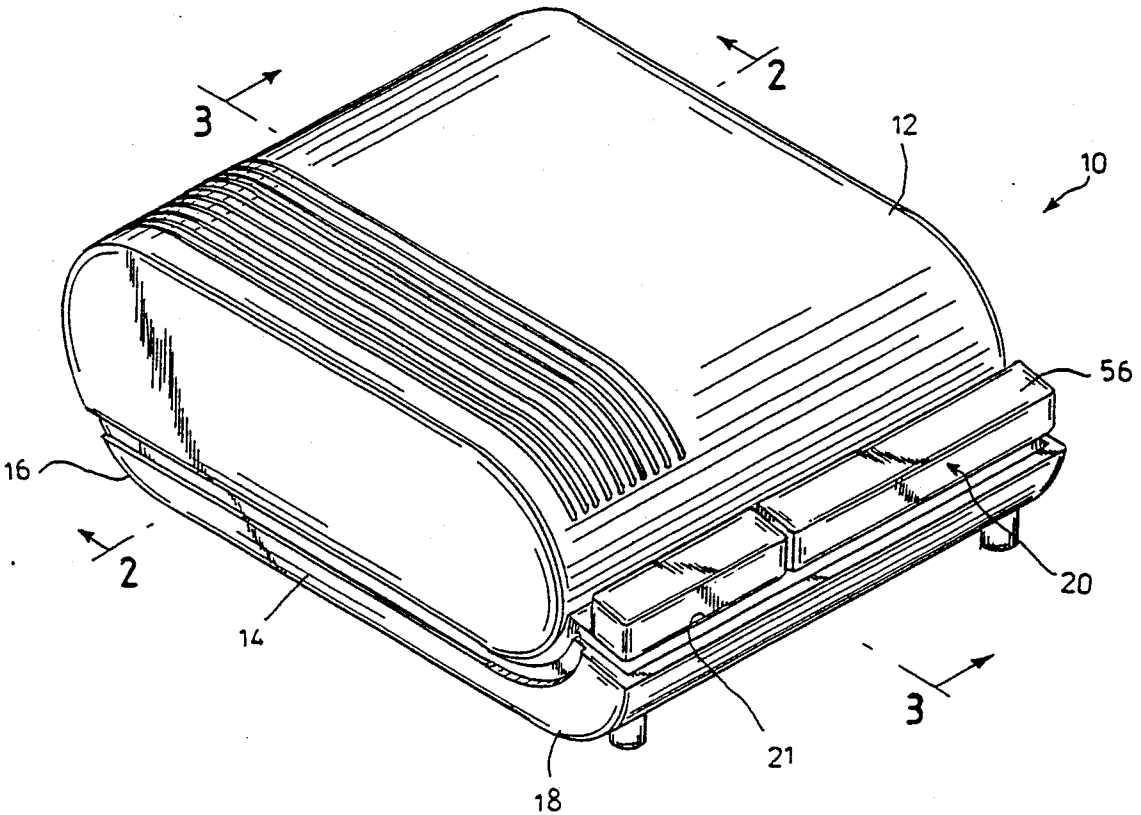
FIG. 1 is an isometric view of the file card container of the present invention.
Figure 3:
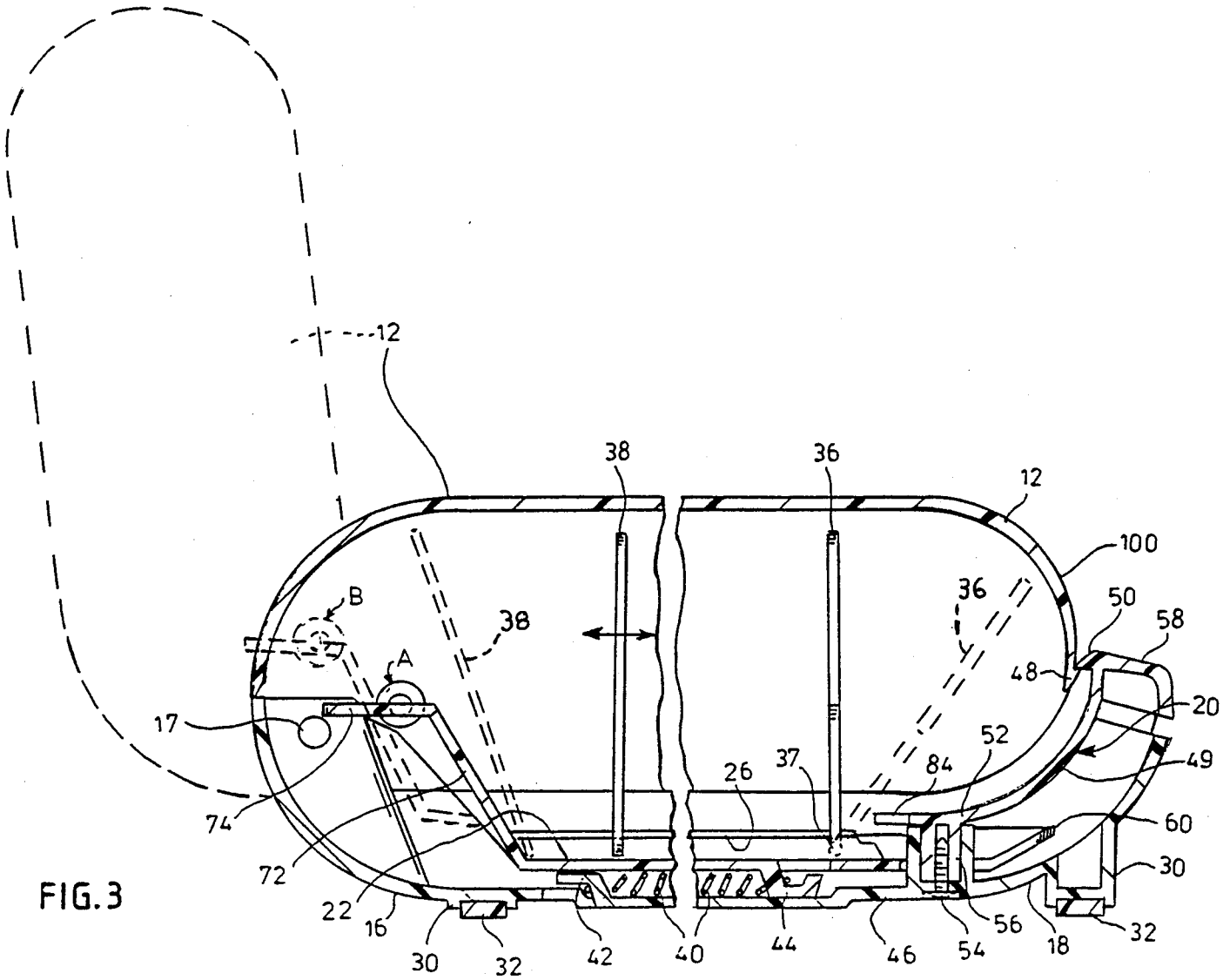
FIG. 3 is a cross-sectional view of the card file index shown in FIG. 1 along the lines 3—3, further showing the open position of the lid in phantom.
Figure 2:
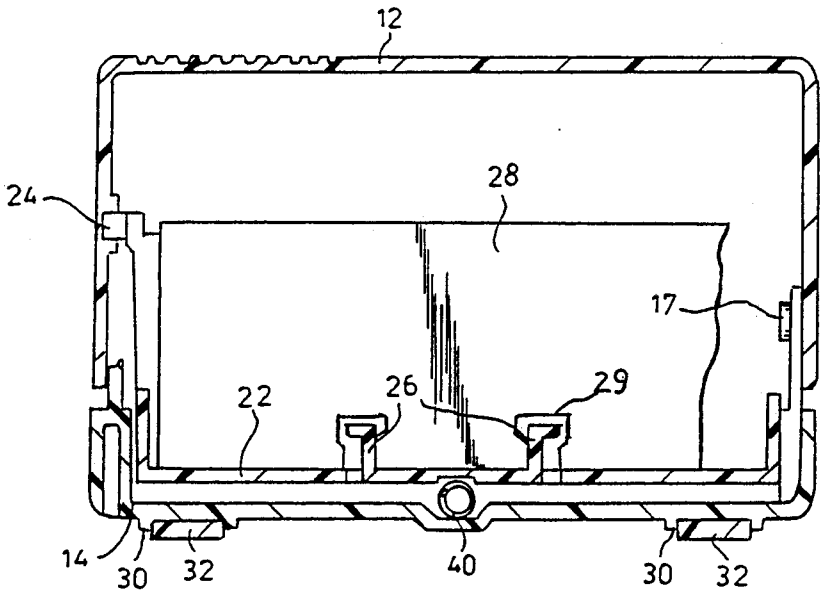
FIG. 2 is a cross-sectional view of the card file container of FIG. 1 along the lines 2—2 thereof, with portions broken away to show internal construction.

Referring to FIGS. 1–6 there is shown a card file container generally denoted as 10 which includes a cover or lid 12 and a base 14. The cover 12 is pivotally connected to the base 14 at a rear portion 16 thereof at hinge or pivot point 17 (FIGS. 2 & 3). At the front portion 18 of the base 14 there is located a locking assembly generally denoted as 20.

As seen in FIG. 2 a card carrier plate 22 is slidably mounted within the base and pivotally connected to cover 12 at a pair of hinge points 24 (only one of which is shown in FIG. 2). Carrier plate 22 includes a pair of upstanding rails 26 which are designed to capture and hold standard flip index or file cards 28. The rails 26 are shaped to receive a standard flip file card. Each card 28 has two cutouts 29 in the bottom thereof for insertion on rails such as 26. The rails 26 are generally L-shaped with the short leg of the L extending outwardly towards the sides of the base member 14 and disposed to capture the cutouts in the file card. The file card container 10 is preferably mounted on feet 30 which are equipped with rubber pads 32.

Referring to FIG. 3, carrier plate 22 includes a first card support plate 36 pivotally attached thereon at pivot points 37 and located on the carrier plate towards the front portion 18 of base member 14. A second card support plate 38 is rearwardly disposed on the rails 26 of plate 22 towards rear portion 16 of the base. The second card support 38 may be removable and may be slidably adjusted forwardly or rearwardly, in the direction of the arrows on FIG. 3, to allow for the accomodation of varying quantities of flip index cards which are installed between first and second plates 36 and 38 respectively. A spring 40 forms the only interconnection between base 14 and carrier plate 22. One end of spring 40 is attached to the base 14 at hook portion 42. The other end of the spring is attached to a hook 44 which is formed on the underside of carrier plate 22. Since carrier plate 22 is attached to cover 12 at pivot point 24 the carrier plate will slide rearwardly within the base as the lid 12 is moved from the closed position of FIG. 3 to the open position shown in phantom thereon and in FIG. 4. Because pivot point 17 is disposed rearwardly of pivot point 24 when the lid is closed, as the lid opens pivot point 24 moves upwardly from the point marked "A" to the point marked "B" in FIG. 3. Thus upon opening carrier plate 22 moves rearwardly and upwardly within the base 14 thereby unloading spring 40. When the lid is moved to the closed position pivot point 24 and therefore carrier plate 22 moves forwardly with respect to the base and spring 40 is elongated and therefore put under increasing tension. The preferred spring 40 is a spiral wound spring whose diameter is designed to fit between the bottom 46 of base 14 and the bottom of carrier plate 22.

Figure 5A:
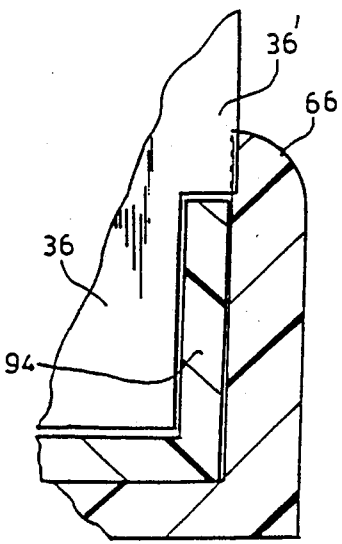
FIG. 5A is an enlarged partial cross-sectional view of the circled area in FIG. 5.
Figure 5:
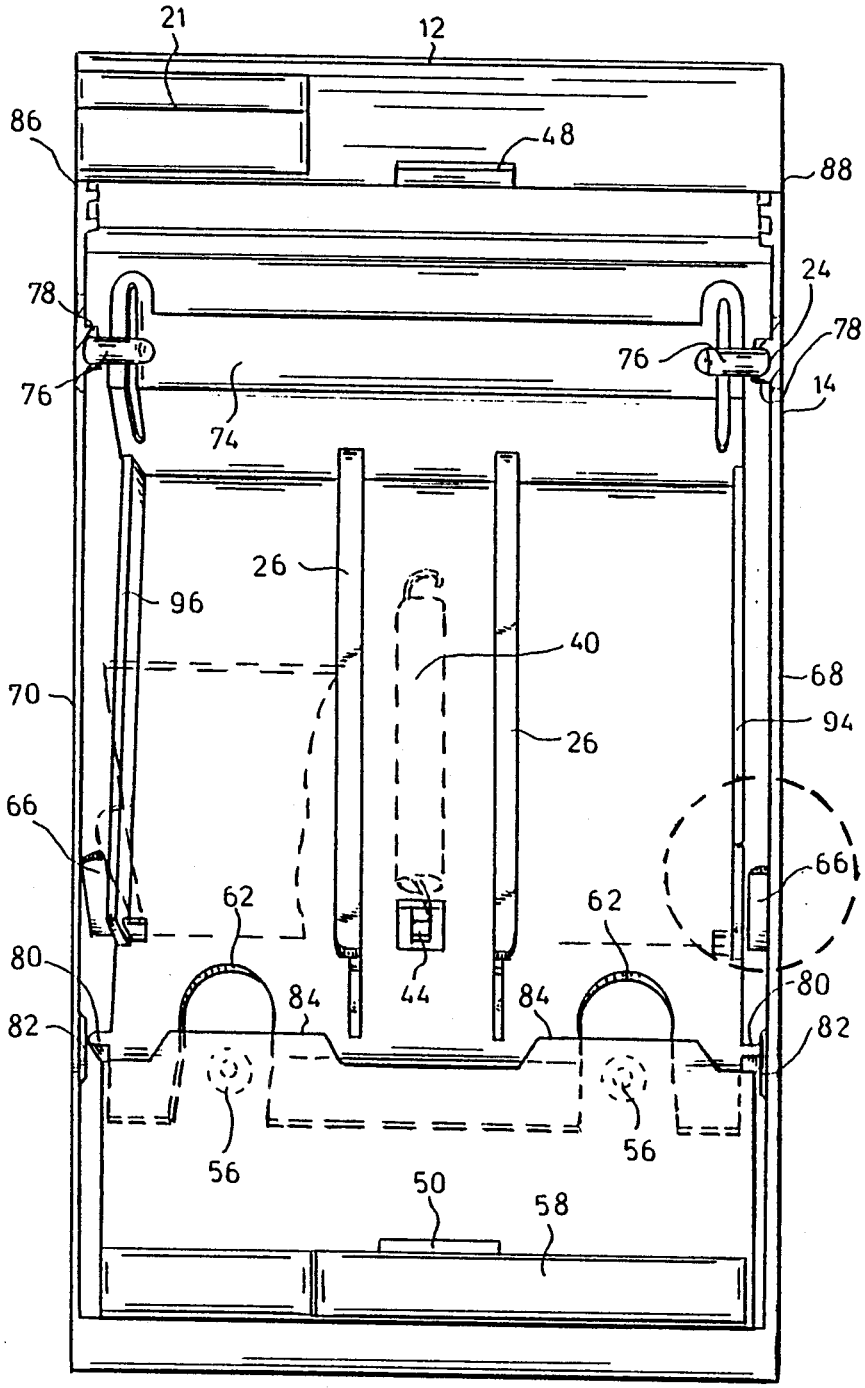
FIG. 5 is a low angle isometric view of the card file container shown in FIG. 4, with portions broken away to show internal construction.
Figure 6:
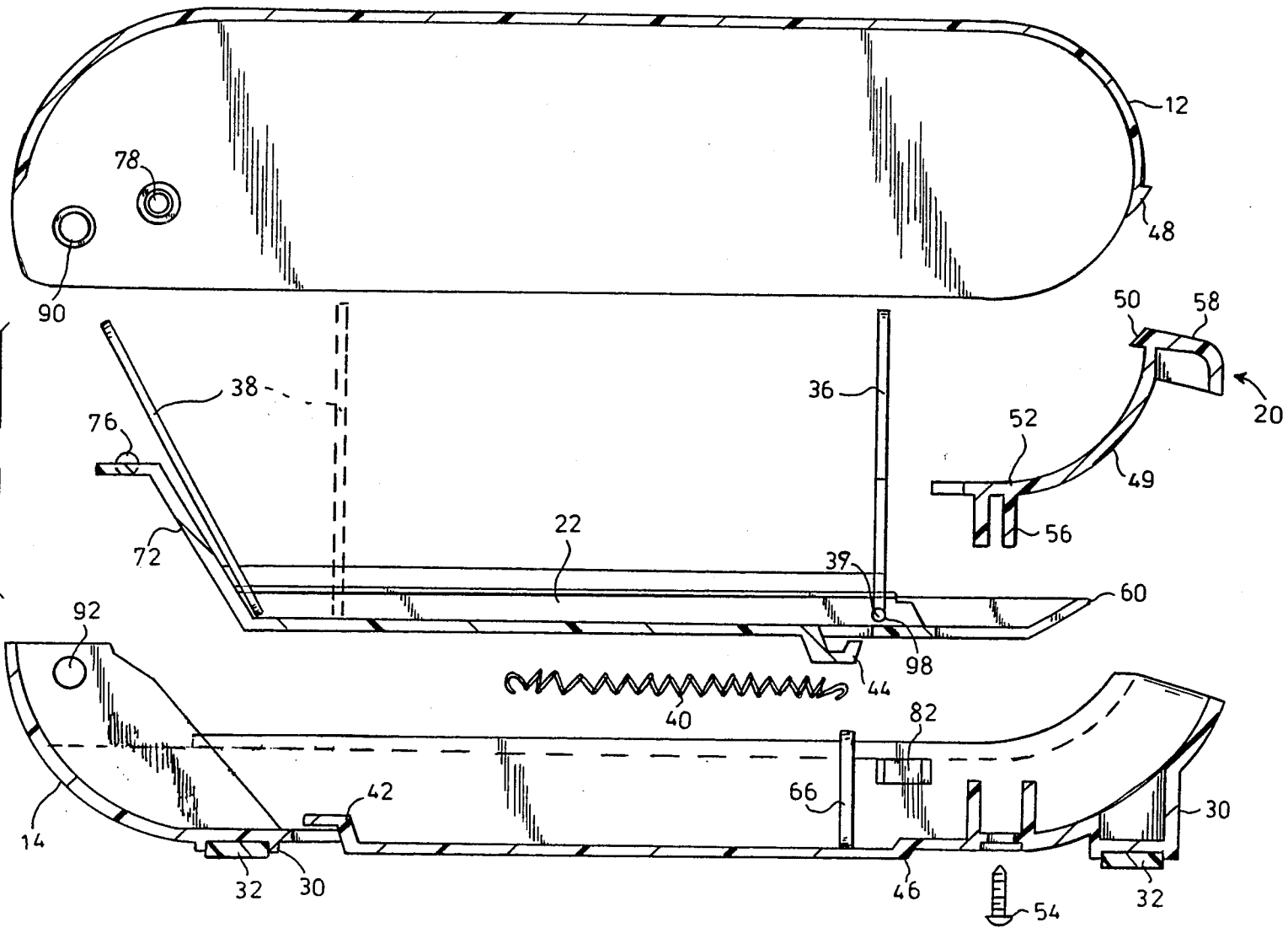
FIG. 6 is an exploded sectional view, in part elevation, of the card file container shown in FIG. 1.

As seen in FIGS. 3, 5 and 6, the lid 12 has a locking element 48 and a closing bar 21 located at the front edge thereof(FIG. 5). The locking element 48 extends outwardly from the cover 12 and engages an inwardly facing locking element 50 on locking assembly 20. The locking assembly 20 includes a curved plate 49 which is mounted to the base 14 at the rearward end 52 thereof by a threaded fastener 54. The threaded fastener 54 extends through the bottom plate 46 of the base 14 and into a recess portion 56 on the plate 49. Since plate 49 is attached to the base 14 only at end 52 thereof, the locking element 50 is free to flex inwardly and outwardly due the inherent flexibility of the material from which plate 49 of locking assembly 20 is made. Normally this material would be plastic but a metal structure could be utilized if the thicknesses were adjusted to provide the required flexiblilty to allow locking element 50 to move outwardly upon application of pressure on release bar 58 of locking assembly 20.

In the preferred embodiment, as shown best in FIG. 5, the locking assembly 20 utilizes two extensions 56 and threaded fasteners 54 to hold end 52 of plate 49 onto the base 14. As the pivot point 24 moves from "B" to "A", the forward end 60 of carrier plate 22 slides beneath locking assembly 20 past extensions 56. The carrier plate 22 has a pair of cutouts 62 to allow the forward edge of the carrier member 60 to avoid hitting extensions 56 as it slides forward in the base as the cover 12 is closed.

Figure 4:
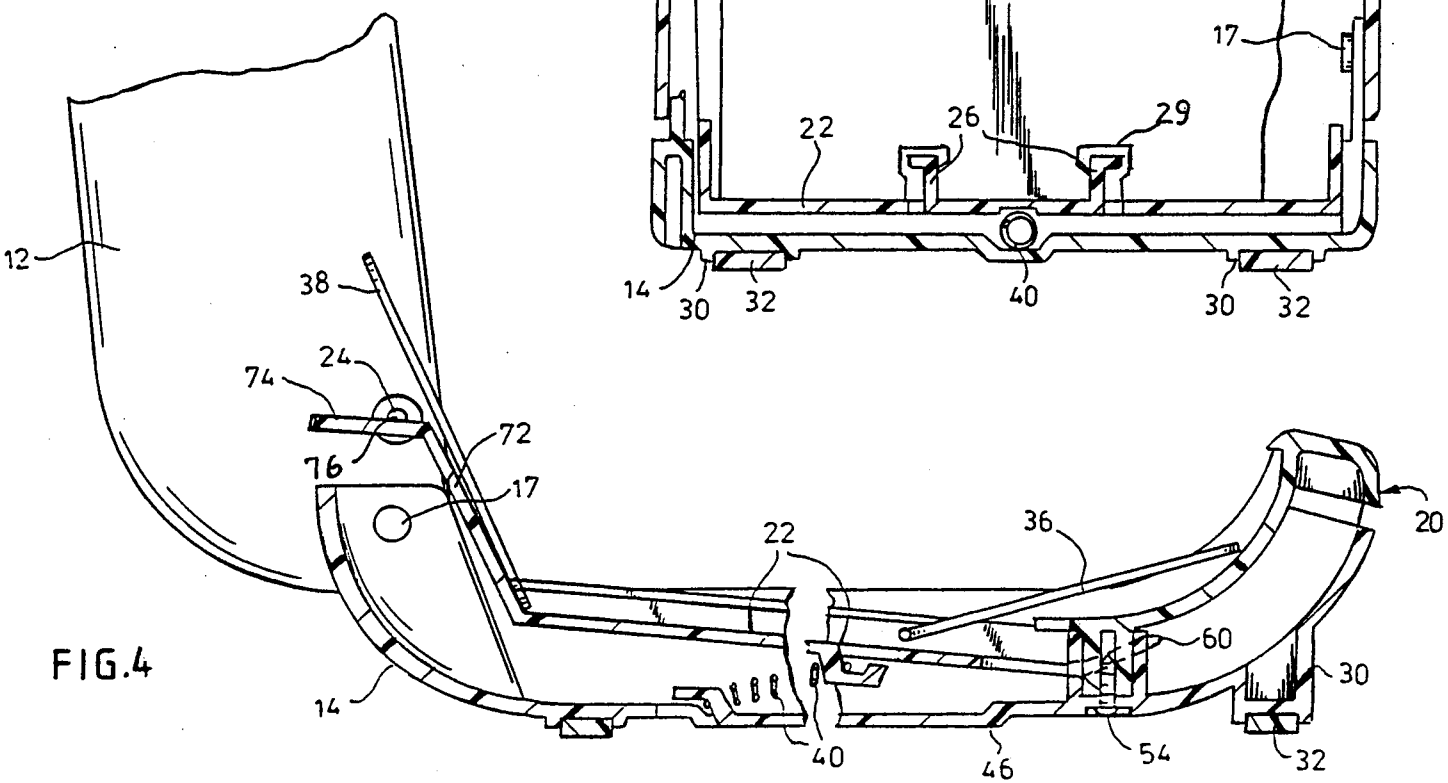
FIG. 4 is a cross-sectional view of the card file container shown in FIG. 1 along the lines 3—3 but in the open position.

As carrier plate 22 is tilted and moved upwardly and rearwardly when the lid 12 is open, the card support members 36 and 38 assume a position advantageous for the display of flip cards 28. The card support member 36 assumes a generally horizontal position which, as can be seen in FIG. 5, is caused by the interaction between the card support member 36 and the vertical rib 66 which is formed on and extends from the side walls 68 and 70 of base member 14. This interaction, shown in FIG. 5A, is the result of the width of laterally projecting tab portions 36' of card support member 36 being slightly greater than the inward extension of ribs 66. Thus when carrier plate 22 moves rearwardly as the cover is moved to the open position, the tab portions strike ribs 66 causing the card support member 36 to pivot and fall forwardly to a generally horizontal position (FIG. 4). Card support member 38 is normally in a position which is inclined towards the rear of the card file and parallel to the rearwardly inclined back surface 72 of carrier plate 22.

As seen in FIG. 5, carrier plate 22 has a generally horizontally extending rear shelf 74 from which the pivot pins 76 extend laterally outwardly into receptacles 78 formed on the inside of cover 12 thereby forming pivot connection point 24. In addition, carrier plate 22 has a pair of outwardly extending rib portions 80 on the front portion thereof which come into contact with friction pads 82 formed on the inside of walls 68 and 70 of base member 14. The purpose of the ribs 80 and the friction pads 82 is to slow the rearward movement of carrier plate 22 upon the action of spring 40 and thereby produce a more gradual opening of the cover.

As can also be seen in FIG. 5, the locking assembly 20 has a pair of rearwardly extending cam surfaces 84 positioned vertically above carrier plate 22. As the carrier plate moves forward these two extensions 84 come into contact with then horizontally extending card support member 36 and force the card support member to rotate about pivot connection 37 until card support member 36, and any of the file cards 28 behind it, assumes a position slightly rearwardly inclined from the vertical.

As can be seen in FIG. 6, the file card holder 10 of the present invention is comprised of a minimum number of parts which are preferably molded from plastic. The only fixed mechanical joint in the assembly is between the locking assembly 20 and the base 14. The carrier plate 22, is slidably mounted within the base and interconnects with the base only in that one end of spring 40 is placed over hook 44 on the carrier plate 22 and the other end placed over the hook 42 formed in the bottom wall 46 of the base 14. The carrier plate 22 is rotatably mounted on the cover 12 by pivot pins 76 being inserted into recesses 78 on either side wall 86 or 88 of cover 12. The cover 12 is mounted on base 14 by flexing the side walls 86 and 88 outwardly to allow outward movement of pin 90 in cover 12 to be inserted through hole 92 in base 14 thereby forming pivot connection 17. Card support member 38 may be slid onto rails 26 of carrier plate 22 and card support plate 36 is inserted between side walls 94 and 96 of carrier plate 22 with extensions 39 thereon extending through corresponding holes 98 in side walls 94 and 96 to form pivot connection 37.

To operate the file card container 10 with file cards 28 already positioned therein and with cover 12 in the closed position one would press the release bar 58 of the locking assembly 20 thereby deflecting locking element 50 away from the locking element 48 on cover 12. Upon disengagement of the locking elements 48 and 50, spring 40 causes cover 12 to automatically swing to the open position as shown in phantom in FIG. 3. This is because the spring 40 is extended and put under tension when the cover 12 is closed. Upon release of the locking elements 48, 50, the carrier plate 22 moves rearwardly within base 14 due to the contraction of spring 40, which in turn forces, through pivot connection 24, cover 12 to the open position. This causes pivot point 24 to move from location "A" to location "B" under the action of spring 40. As carrier plate 22 moves rearwardly, the side friction pads 82 engage ribs 80 on carrier member 22 to thereby slow the movement of the cover to the open position. As the carrier plate 22 moves further rearwardly, the extended tab portion 36' on card support plate 36 contacts rib 66 on side wall 68 and 70 of the base 14 causing the plate 36 to fall forwardly, assuming a generally horizontal position thereby exposing the cards 28 for use.

Furthermore, as carrier member 22 moves rearwardly, pivot point 24, being located forward of pivot point 17, rotates upward causing the rear of carrier plate 22 to move vertically upward and rearward as the lid springs open. In this position the cards 28 are automatically presented for easy reviewing to allow for finding phone numbers, addresses, etc.

To close the file card assembly 10 the cover is moved towards the closed position causing the carrier plate 22 to be moved forward thereby tensioning spring 40. As the plate 22 moves forward the end 60 of carrier plate 22 slides under the locking assembly 20. As heretofore described the cam members 84 engage plate 36 thereby moving it and cards 28 towards and somewhat past the vertical position. Locking elements 48 and 50 are so configured that upon closing the bottom inclined surface of locking element 48 engages an inclined surface of locking element 50 thereby deflecting release bar 58 of locking assembly 20 outwardly away from locking element 48 until locking element 50 is located vertically above locking element 48 in which case locking element 50 springs inwardly into contact with the outer surface 100 of lid 12 in a snap-fit manner, thereby preventing vertically upward movement of locking element 48.

File card assembly 10 can be dimensioned to hold any number of cards by merely varying the length of the assembly without deviating from the major features herein above described. It should also be noted that, while the preferred card holder is fabricated from molded plastic, many parts could be fabricated from sheet metal. In addition, the outer configuration of the card holder is designed for aesthetic appeal and can be varied in a wide range of designs to meet any aesthetic criteria. Furthermore, the cover may be equipped with a forwardly extending handle to facilitate closure of the card file. As shown in FIG. 1, this handle 21 may be aligned with the release bar 56 of locking assembly 20. In addition, locking elements 48, 50 may extend along any convenient length of release bar 56 and cover 12 so long as there is sufficient engagement to insure proper locking of the cover in the closed position.

The present invention provides an extremely economical, easy to operate and effective container for holding flip index file cards. The foregoing description is illustrative of the present invention and various modifications and embodiments have been suggested and others will be readily available to those skilled in the art.

What is claimed is:

1. A file card container comprising:

a base including front and rear portions, and having an open top;

a cover pivotally connected to the rear portion of the base, said cover capable of pivoting from an open position to a closed position covering the open top of the base;

a carrier slidably mounted within the base and pivotally connected to said cover, said pivot connection between the base and said cover being disposed rearwardly and upwardly of said pivot connection between said cover and said carrier when said cover is in said closed position whereby said carrier slides rearwardly and upwardly as said cover moves to said open position;

biasing means cooperating with said base and capable of urging said carrier rearwardly and said cover to said open position; and means for locking said cover in said closed position against the action of said biasing means.

2. A card file container as set forth in claim 1, further including:

a first card support plate pivotally coupled to said carrier means; and a first cam element fixed with respect to said base and positioned to engage said first card support plate as said cover moves to said closed position and said carrier slides forward thereby causing said first card support plate to assume a generally vertical position.

3. A container card file as set forth in claim 1, wherein said locking means further includes a release means attached to the front portion of said base member capable of holding said cover in said closed position against the action of said spring means and releasing said cover upon actuation thereof.

4. A card file container as set forth in claim 3, wherein said release means includes a plate having a first end thereof attached to said base and having a locking element at a second end thereof capable of deflecting outwardly away from a locking element on said cover for releasing said cover and deflecting inwardly toward said cover upon closing thereof to thereby capture said locking element on said cover.

5. A card file container as set forth in claim 4, wherein said first end of said plate forms said first cam element.

6. A card file container as set forth in claim 1, further including rib means associated with said base for engaging said first card support plate as said carrier means moves rearwardly thereby causing said first plate to assume a generally horizontal position as said carrier plate moves rearwardly.

7. A card file container as set forth in claim 1, wherein said carrier means includes a pair of rails for capturing standard flip index cards.

8. A card file container as set forth in claim 1, wherein said carrier means has a second plate at the rear thereof for supporting said index cards when said lid is in said open position.

9. A card file container as set forth in claim 1, wherein said biasing means comprises a coil spring having one end attached to said base and the other end attached to said carrier means, whereby said coil is elongated as said carrier plate moves forward.

10. A card file container as set forth in claim 9, wherein release of said locking means allows for the contraction of said spring thereby causing said carrier means to move rearwardly and said cover means to move to said open position.

11. A card file container as set forth in claim 10, wherein said carrier means and said base each include a friction element engageable with one another upon opening of said cover to thereby retard said rearward movement of said carrier means.

12. A file card container comprising:

a hollow base having an open top and front and rear portions;

a cover for enclosing the open top of the base;

first pivot means pivotally connecting the cover to the rear portion of the base;

a carrier plate having front and rear ends and slidably mounted within the hollow base;

second pivot means pivotally connecting the cover to the rear of the carrier plate, the axis of rotation of the first and second pivot means being parallel, the first pivot connection being disposed rearwardly of said second pivot connection when the cover is in the closed position;

a spring coupled to the base and said carrier plate and capable of urging said carrier rearwardly and said cover to an open position; and means for locking the cover in the closed position against the action of said spring.

* * * * *